US005875950A

United States Patent [19]

Nuss et al.

[11] Patent Number: 5,875,950

[45] Date of Patent: Mar. 2, 1999

[54] NAIL DRIVING APPARATUS

[75] Inventors: Bart A. Nuss, Fisherville; Gregory M. Gibbons, Louisville; L. R. Leet, Sr., Shelbyville; Ved P. Gakhar, Louisville, all of Ky.

[73] Assignee: Credo Tool Company, Woodburn, Oreg.

[21] Appl. No.: 951,002

[22] Filed: Oct. 15, 1997

[51] Int. Cl.[6] ..... B25C 1/02

[52] U.S. Cl. ..... 227/113; 227/147; 227/140; 173/91

[58] Field of Search ..... 227/147, 113, 227/133, 140; 173/90, 91; 81/24, 23, 27

[56] References Cited

U.S. PATENT DOCUMENTS

| | | | |
|---|---|---|---|
| D. 374,158 | 10/1996 | Harris, Jr. | D8/51 |
| 585,123 | 6/1897 | Severance | 7/166 |
| 608,555 | 8/1898 | Nazel | 227/147 |
| 620,426 | 2/1899 | Danzer | 227/64 |
| 913,014 | 2/1909 | Kafer | 227/147 |
| 1,141,073 | 5/1915 | Parks | 227/140 |
| 1,604,675 | 10/1926 | Bernard | 227/147 |
| 2,147,828 | 2/1939 | Daniels | 17/7 |
| 2,430,532 | 11/1947 | Rayburn | 227/147 |
| 2,624,879 | 1/1953 | Baird | 227/147 |
| 2,701,359 | 2/1955 | Asbury | 227/140 |
| 2,727,235 | 12/1955 | Cameron | 1/47 |
| 2,759,184 | 8/1956 | Wood | 227/140 |
| 2,829,369 | 4/1958 | Browning | 227/113 |
| 2,973,520 | 3/1961 | Bell | 227/147 |
| 3,036,482 | 5/1962 | Kenworthy et al. | 81/52.35 |
| 3,117,378 | 1/1964 | Bowen | 33/74 |
| 3,519,087 | 7/1970 | Santi | 173/91 |
| 3,934,779 | 1/1976 | Dent | 227/147 |
| 3,979,040 | 9/1976 | Denin | 227/113 |
| 4,085,882 | 4/1978 | Stamper | 227/110 |
| 4,120,438 | 10/1978 | Litch | 227/147 |
| 4,241,795 | 12/1980 | Landry, Jr. | 173/90 |
| 4,299,021 | 11/1981 | Williams | 29/432 |
| 4,316,513 | 2/1982 | Harris | 173/91 |
| 4,461,418 | 7/1984 | Schaefer | 227/147 |
| 4,483,475 | 11/1984 | Whitaker | 227/147 |
| 4,485,956 | 12/1984 | Van Iperen | 227/147 |
| 4,676,424 | 6/1987 | Meador | 227/147 |
| 4,978,047 | 12/1990 | Chen | 227/147 |
| 5,370,192 | 12/1994 | Evinger | 173/90 |
| 5,605,271 | 2/1997 | Russell | 227/147 |

*Primary Examiner*—Scott A. Smith
*Assistant Examiner*—James P. Calve
*Attorney, Agent, or Firm*—McDermott, Will & Emery

[57] ABSTRACT

A nail driving apparatus including a handle having a first and second end and a rod member having a first end permanently secured to a second end of the handle and a second end forming a striking surface, where the handle and the rod member are secured together so as to form a longitudinal axis. The apparatus further includes an elongated guide tube having a first end and a second end, where the rod member is slidably disposed within the guide tube. The handle further includes a tapered annular ring located about the rod member. The annular ring is operative for receiving the first end of the guide tube within the handle, and for temporarily securing the guide tube to the handle.

20 Claims, 5 Drawing Sheets

10

10

NAIL DRIVING APPARATUS

BACKGROUND OF THE INVENTION

1. Field of the Invention

The present invention relates to a nail driving apparatus which is particularly useful for driving nails in areas or places where it is difficult to use an ordinary hammer.

2. Description of Related Art

Numerous occasions arise where it is necessary to drive a nail to hold components together, but where the location of the components is such that it is impossible to utilize a standard hammer to drive the nail. Typically, in such cases, there is inadequate room to swing the hammer to obtain the necessary velocity to drive the nail.

Various devices have been developed in an effort to overcome the foregoing problems. For example, U.S. Pat. No. 4,483,475 discloses a nail driving apparatus comprising a tube member which functions as a guide for a rod member which is attached to a handle. In operation, a nail is placed within the tube member at a lower end thereof. The rod member, which is slidable moveable within the tube member is then raised in relation to the nail by lifting the handle. The handle is then forcefully driven downward which results in the rod member striking the nail, thereby driving the nail into a surface. This action is repeated until the nail is driven to the desired depth.

Notwithstanding the fact that the foregoing nail driving apparatus allows nails to be driven in areas not suitable for use of a standard hammer, such known nail driving apparatus suffer from significant drawbacks. For example, one significant drawback is that the rod member can be completely removed from the tube member if the operator retracts the handle to far. As a result, the operator must make slower more deliberate movements to insure the rod member remains in the tube member, which results in an increase in hammering time to drive a given nail. It also typically results in decreased hammering force because the operator naturally limits the upper swing of the handle to prevent the rod member from separating from the tube member.

Another disadvantage is that known nail driving apparatus do not provide a simple, cost effective means of securing the rod member within the tube member when the device is not in use. This is desirable in order to minimize the size of the device for storage, as well as to minimize the likelihood of inadvertent damage to the device.

Accordingly, there remains a need for a nail driving apparatus that eliminates the possibility of the rod member from being inadvertently dislodged from the tube member during operation, and that provides a simple, cost effective means for securing the rod member to the tube member when the device is stored.

SUMMARY OF THE INVENTION

The present invention relates to a nail driving apparatus that satisfies the aforementioned deficiencies in the prior art. More specifically, the present invention relates to a nail driving apparatus comprising a handle and a rod member having a first end permanently secured to the handle and a second end forming a striking surface, where the handle and the rod member are secured together so as to form a longitudinal axis. The apparatus further comprises an elongated guide tube having a first end and a second end. The rod member is slidably disposed within the guide tube. The handle further comprising a tapered annular ring located about the rod member. The annular ring is operative for receiving the first end of the guide tube within the handle, and for temporarily securing the guide tube to the handle.

The present invention provides important advantages over the prior art. Most importantly, the design of the present invention provides a cost effective method of securing the guide tube to the handle when the apparatus is not in use. Such securing of the guide tube facilitates minimizing the potential of damage to the apparatus during transport, as well as the overall size of the apparatus.

Another advantage is that the design of the guide tube and the rod member are such that the rod member cannot be removed from the guide tube during normal operation of the apparatus. This allows the operator to hammer as fast as possible, thereby decreasing nailing time and increasing hammer force, without the risk of having to continually interrupt the hammering operation to reposition the rod member within the guide tube.

Yet another advantage is that the present invention provides a magnet retaining means comprising a scratch proof surface so as to allow the apparatus to rest on a surface to be nailed without causing damage to the surface. The magnet retaining means also functions to hold a nail within the guide tube.

Additional advantages of the present invention will become apparent to those skilled in the art from the following detailed description of the preferred embodiment, which exemplifies the best mode of carrying out the invention.

The invention itself, together with further objects and advantages, can be better understood by reference to the following detailed description and the accompanying drawings.

DETAILED DESCRIPTION OF THE PRESENT INVENTION

Figure 1:
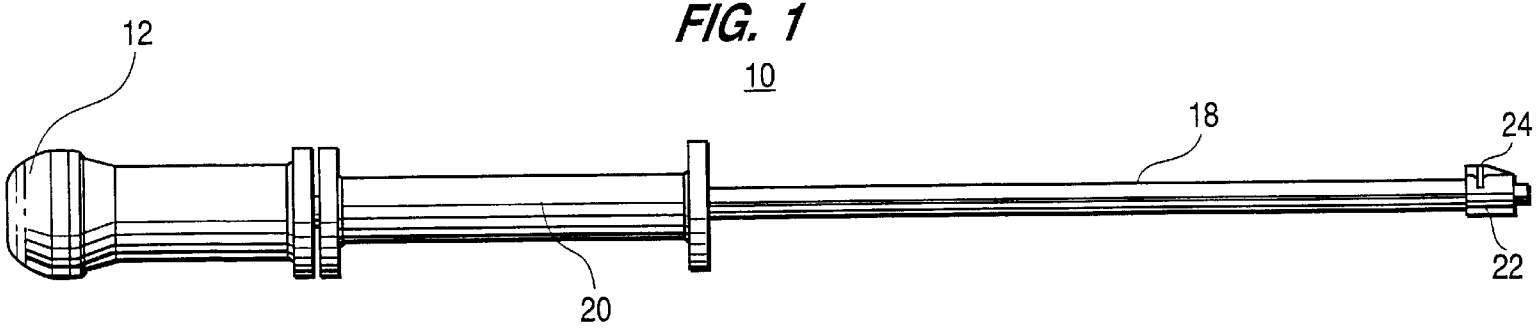
FIG. 1 illustrates the preferred embodiment of the nail driving apparatus of the present invention.
Figure 2:
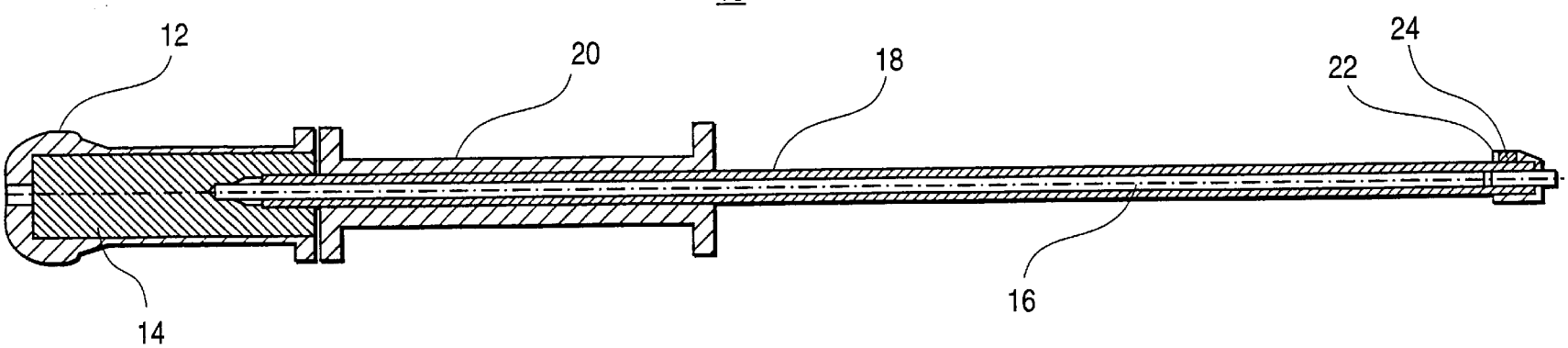
FIG. 2 is a cross-sectional view of the nail driving apparatus of FIG. 1 taken about the center axis of the apparatus.

The nail driving apparatus of the present invention is operative for holding, positioning and manually driving common nails. The apparatus is particularly useful for driving nails in hard to reach places. Referring to FIGS. 1 and 2, in the preferred embodiment, the apparatus 10 comprises a handle 12, a handle weight 14, a rod member 16, a guide tube 18, a tube grip 20, a magnet retaining means 22 and a magnet 24.

As shown, the handle 12 has an outer shape which facilitates the operator grasping the handle 12. The inner section of the handle 12 is hollow so as to allow the handle to receive a handle weight 14 therein. The handle weight 14 functions to provide increased "striking force" during operation. Any suitable means of securing the handle 12 to the handle weight 14, such as by adhesive or a screw, can be utilized.

Figure 3:
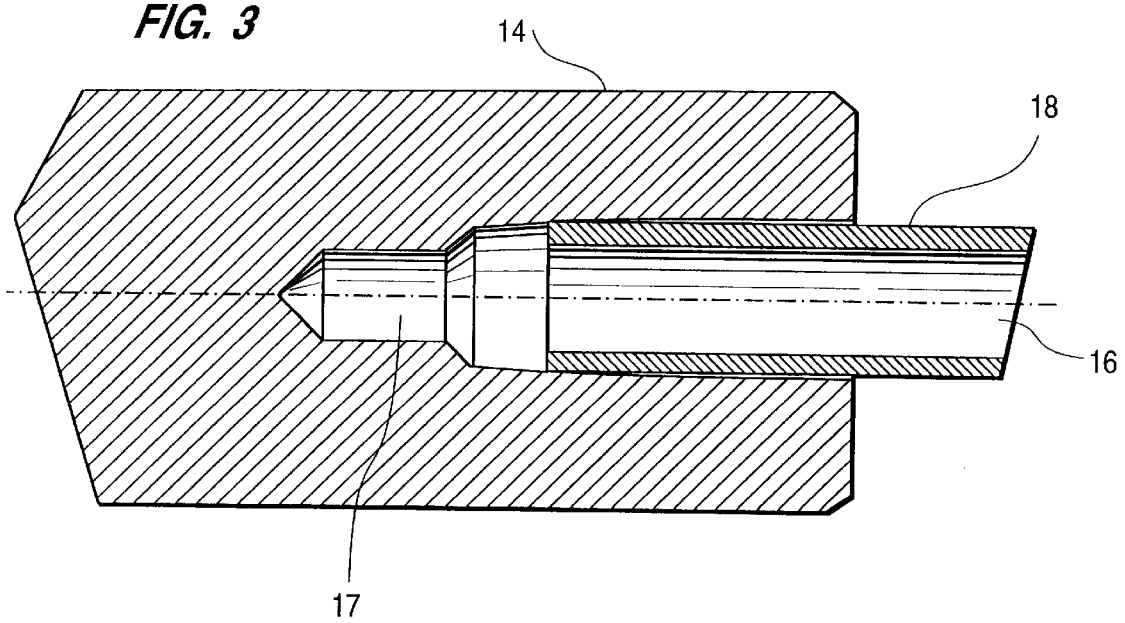
FIG. 3 illustrates the interconnection between the handle and the guide tube of the present invention, with the guide tube in the stored position.

Referring to FIGS. 2 and 3, the handle weight 14 is configured to receive and retain both the rod member 16 and the guide tube 18. More specifically, the rod member 16 is permanently affixed to the handle weight 14. While not shown, this can be accomplished by providing an insertion portion 17 of the rod member 16 with threads and providing the handle weight 14 with counter threads such that the insertion portion 17 screws into the handle weight 14. Of course any other suitable means of permanently securing the rod member 16 to the handle weight 14 can be utilized. Furthermore, it is also noted that the handle 12 and the handle weight 14 can be replaced or combined into a unitary component.

Preferably, the handle 12 and the tube grip 20 are formed from a flexible vinyl or similar material so as to provide a firm and comfortable surface for the user to grasp the tool. The wide flanges function to cushion the tool upon impact in the event the tool is inadvertently dropped, and to protect the operator from "pinch points" between the moving parts. The handle weight 14 preferably comprises steel.

Turning to the guide tube 18, in normal operation the guide tube 18 is moveable in relation to the rod member 16 and the handle 12. However, when the apparatus 10 is not in use it is desirable to temporarily secure the guide tube 18 to the handle 12 so as to minimize the overall size of the apparatus 10 and the likelihood that the apparatus 10 would be inadvertently damaged while being stored or transported.

Referring to FIG. 3, in accordance with the present invention, the handle weight 14 is provided with an opening (e.g., bore) at its lower end, which exhibits a diameter larger than the diameter of the guide tube 18 such that the guide tube 18 is movable within the opening. Importantly, however, the diameter of the opening tapers as the opening approaches the insertion portion 17 of the rod member 16 such that the guide tube 18 engages with the inner surface of the handle weight 14 when the guide tube 18 is fully inserted into the opening. The degree of the taper is such that the friction between the outer surface of guide tube 18 and the inner surface of the handle weight 14 is sufficient to retain the guide tube 18 in the fully inserted position. As a result, by applying a downward force, the operator can secure the guide tube 18 to the handle weight 14 when the apparatus is not in use, and then simply apply an opposite force to separate the guide tube 18 and the handle weight 14 when the apparatus is to be utilized again. The storage action can be repeated throughout the life of the apparatus.

Preferably, the guide tube 18 is formed from high impact polypropylene. A filler is utilized to increase stiffness. As a result, the guide tube 18 exhibits superior toughness and impact resistance even at low temperatures. Moreover, it has superior chemical resistance and UV stabilization. Finally, the compressibility of the polypropylene guide tube 18 ensures a proper "friction fit" of the guide tube 18 within the handle weight 14.

Figure 4:
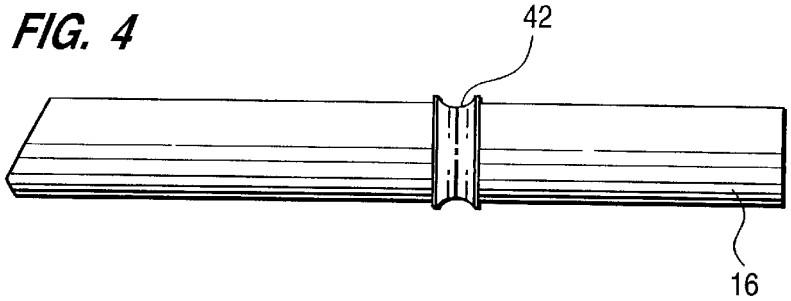
FIG. 4 illustrates one embodiment of the rod member of the nail driving apparatus of the present invention.
Figure 5:
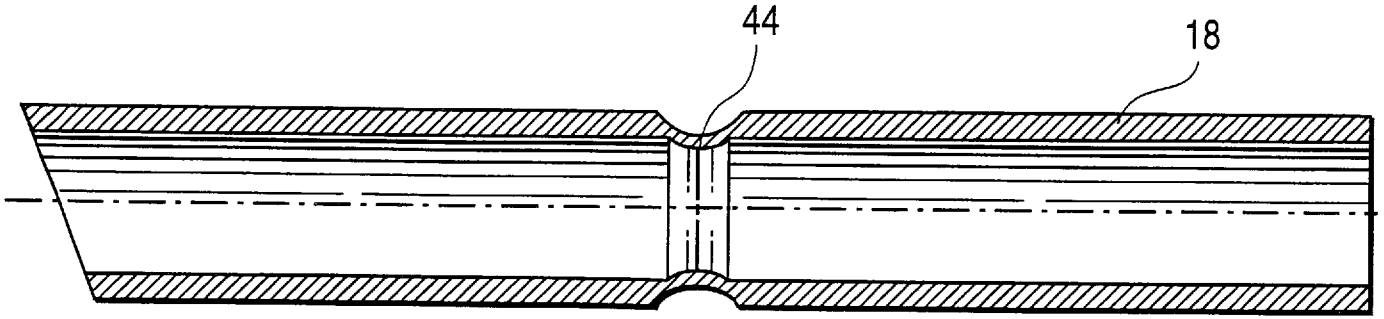
FIG. 5 illustrates one embodiment of the guide tube of the nail driving apparatus of the present invention.

FIGS. 4 and 5 illustrate another novel aspect of the present invention. More specifically, the design of the guide tube 18 and the rod member 16 operate in conjunction with one another so as to prevent the rod member 16 from being removed from the guide tube 18 during operation. In the preferred embodiment, as shown in FIG. 4, a portion of the rod member 16 is deformed such that an annular section 42 thereof exhibits a larger diameter than the remaining portion of the rod member 16. This annular section 42 of the rod member 16 is preferably located near the lower end of the rod member 16. Conversely, as shown in FIG. 5, an annular section 44 of the guide tube 18 is deformed such that it exhibits a decreased diameter as compared to the remaining portion of the guide tube 18. This annular section 44 of the guide tube 18 is preferably located near the top of the guide tube 18 adjacent the handle 12. Importantly, the diameter of the foregoing annular section 42 of the rod member 16 is greater than the diameter of the annular section of the guide tube 18.

In operation, as the handle 12 is retracted prior to the hammering action, the rod member 16 moves upwardly within the guide tube 18. Prior to the rod member 16 being removed from the guide tube 18, the annular section 42 of the rod member 16 abuts (e.g., engages) the annular section 44 of the guide tube 18 and the upward movement of the rod member 16 is thereby halted. As such, the rod member 16 cannot be removed from the guide tube 18 during operation.

Figure 6A:
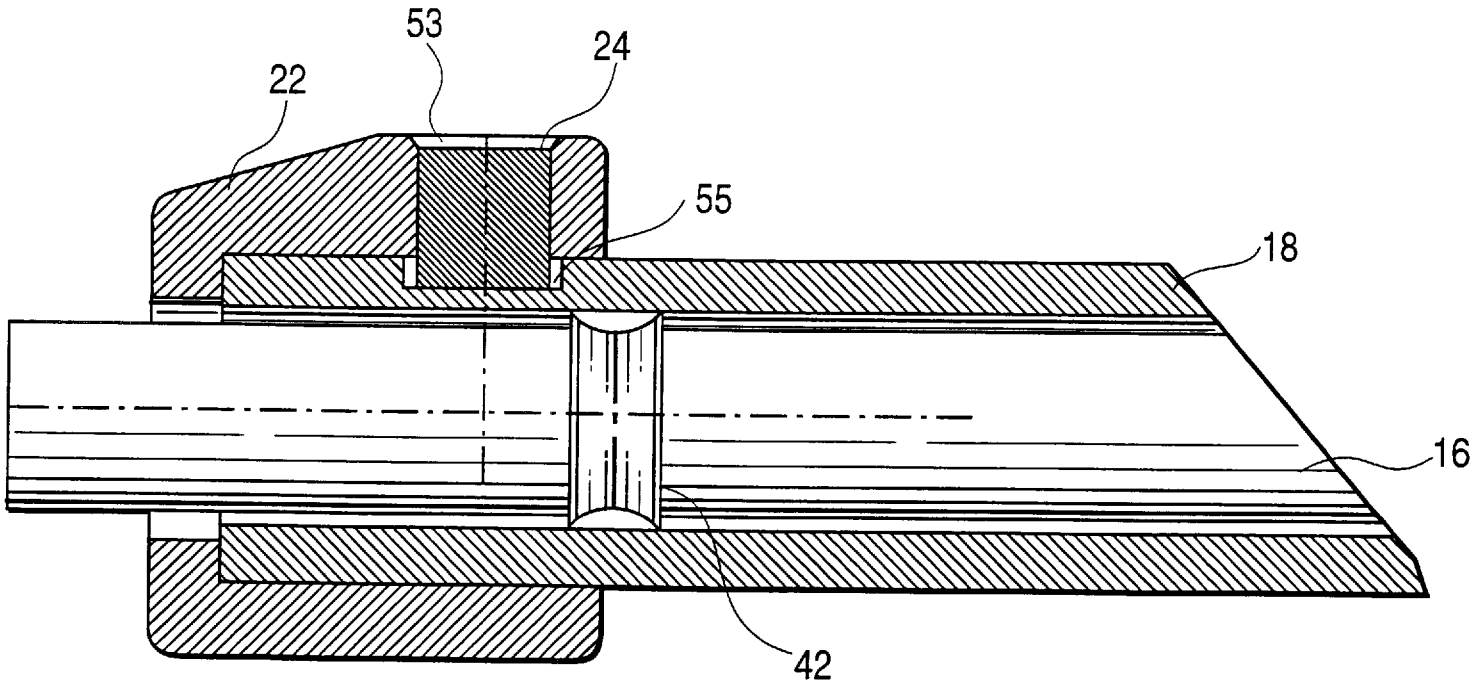
FIGS. 6A and 6B illustrate one embodiment of the magnet retaining means of the present invention.
Figure 6B:
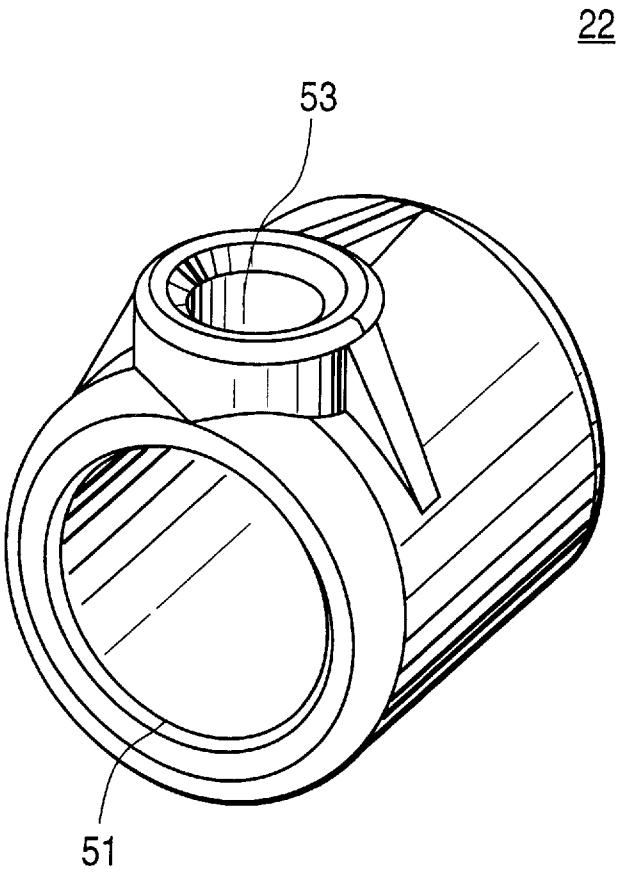

Turning now to FIGS. 6A and 6B, as illustrated therein the nail driving apparatus 10 of the present invention also comprises a magnet retaining means 22 for holding a magnet 24 which retains the nail to be driven. More specifically, the magnet retaining means 22 is a fitting having a longitudinal tube or opening 51 for receiving the guide tube 18. As shown in FIG. 6A, the magnet retaining means 22 is disposed about the lower end of the guide tube 18. The lower end of the opening 51 of the magnet retaining means 22 exhibits a reduced diameter such that the tube guide 18 abuts the magnet retaining means 22 when disposed therein.

Preferably, the magnet retaining means 22 comprises a material, such as thermoplastic polyurethane, that provides a gripping action (i.e., friction surface) on the work surface without marring the surface. The magnet retaining means 22 can be secured to the guide tube 18, for example, via a friction fit or an adhesive. Of course, any other suitable securing means may be utilized.

The magnet retaining means 22 further comprises an opening 53 for receiving the magnet 24. As shown in FIG. 6A, the tube guide 18 comprises a flat bottomed hole 55 in a location corresponding to the opening 53 in the magnet retaining means 22. In the preferred embodiment, the flat bottomed hole 55 extends approximately half-way through the wall of the guide tube 18. Again referring to FIG. 6A, once inserted, the magnet 24 resides within the flat bottomed hole 55 and the opening 53 of the magnet retaining means 22. The magnet 24 can be secured within the openings 51 and 53, for example, via a friction fit or an adhesive. Of course, any other suitable securing means may be utilized.

Upon insertion of the nail into the guide tube 18, the magnetic force generated by the magnet 24 holds the nail in position until the nail is struck by the rod member 16. In the foregoing embodiment, the magnet 24 is positioned perpendicular to the longitudinal axis of the guide tube 18.

Finally, referring again to FIG. 2, the tube grip 20 functions to allow the operator to support and stabilize the apparatus 10 during use thereof. More specifically, the tube grip 20 is permanently fixed by means of friction or adhesive to the guide tube 18. During typical operation, the operator grasps the tube grip 20 with one hand to stabilize the apparatus 10, while the other hand grasps the handle 12 and performs the nailing operation.

The present invention provides important advantages over the prior art. Most importantly, the design of the present invention provides a cost effective method of securing the guide tube to the handle when the apparatus is not in use. Such securing of the guide tube facilitates minimizing the potential of damage to the apparatus during transport, as well as the overall size of the apparatus.

Another advantage is that the design of the guide tube and the rod member are such that the rod member cannot be removed from the guide tube during normal operation of the apparatus. This allows the operator to hammer as fast as possible, thereby increasing nailing time and hammer force, without the risk of having to continually interrupt the hammering operation to reposition the rod member within the guide tube.

Yet another advantage is that the present invention provides a magnet retaining means comprising a scratch proof surface so as to allow the apparatus to rest on a surface to be nailed without causing damage to the surface. Furthermore, the magnet retaining means also functions to hold a nail within the guide tube.

Variations of the foregoing preferred embodiment is also possible. For example, the annular sections to the guide tube and the rod member which operate in conjunction with one another to prevent the removal of the rod member from the guide tube during operation, could be replaced by a channel and tab combination. More specifically, a channel can be formed on the inner surface of the guide tube and a corresponding tab formed on the surface of the rod member. In operation, the tab would reside within the channel, and as a result, the length of the channel would govern the upward movement of the rod member.

Of course, it should be understood that a wide range of changes and modifications can be made to the exemplary embodiments described above. It is therefore intended that the foregoing detailed description be regarded as illustrative rather than limiting and that it be understood that it is the following claims, including all equivalents, which are intended to define the scope of this invention.

What is claimed is:

1. A nail driving apparatus comprising:

a handle having a first and second end;

a rod member having a first end permanently secured to said second end of said handle and a second end forming a striking surface; said handle and said rod member secured together so as to form a longitudinal axis; and an elongated guide tube having a first end and a second end, said rod member being slidably disposed within said guide tube;

said handle further comprising a circular slot located about said rod member, said circular slot defining a tapered circular surface within said handle, said circular slot operative for receiving said first end of said guide tube, said tapered circular surface operative for temporarily securing said guide tube within said handle.

2. A nail driving apparatus according to claim 1, wherein said tapered circular surface has a reduced diameter at one end thereof such that upon forcefully inserting said guide tube into said circular slot, said guide tube engages said tapered circular surface of said handle, said engagement being sufficient to retain said guide tube within said handle.

3. A nail driving apparatus according to claim 2, wherein said guide tube is repeatedly removable from said engagement with said handle by application of a separation force.

4. A nail driving apparatus according to claim 1, further comprising a magnet retaining means for storing a magnet, said magnet retaining means disposed about said second end of said guide tube, said magnet operative for holding a nail within said guide tube.

5. A nail driving apparatus according to claim 1, further comprising a tube grip disposed about said guide tube, said tube grip being secured to said guide tube.

6. A nail driving apparatus according to claim 1, wherein said handle further comprises a weight formed therein.

7. A nail driving apparatus comprising:

a handle having a first and second end;

a rod member having a first end permanently secured to said second end of said handle and a second end forming a striking surface, said rod member comprising an annular section having an increased diameter, said handle and said rod member secured together so as to form a longitudinal axis; and an elongated guide tube having a first end and a second end, said guide tube comprising an annular section having a reduced diameter, said rod member being slidably disposed within said guide tube;

said handle further comprising a circular slot located about said rod member, said circular slot defining a tapered circular surface within said handle, said circular slot operative for receiving said first end of said guide tube, said tapered circular surface operative for temporarily securing said guide tube within said handle;

said annular section of said rod member having a diameter larger than the diameter of said annular section of said guide tube, said annular section of said rod member and said annular section of said guide tube operative for preventing the rod member from being removed from said guide tube during operation.

8. A nail driving apparatus according to claim 7, wherein said annular section of said rod member is located substantially adjacent to said second end thereof and said annular section of said guide tube is located substantially adjacent to said first end thereof.

9. A nail driving apparatus according to claim 7, wherein said tapered circular surface has a reduced diameter at one end thereof such that upon forcefully inserting said guide tube into said circular slot, said guide tube engages said tapered circular surface of said handle, said engagement being sufficient to retain said guide tube within said handle.

10. A nail driving apparatus according to claim 9, wherein said guide tube is repeatedly removable from said engagement with said handle by application of a separation force.

11. A nail driving apparatus according to claim 7, further comprising a magnet retaining means for storing a magnet, said magnet retaining means disposed about said second end of said guide tube, said magnet operative for holding a nail within said guide tube.

12. A nail driving apparatus according to claim 7, further comprising a tube grip disposed about said guide tube, said tube grip being secured to said guide tube.

13. A nail driving apparatus according to claim 7, wherein said handle further comprises a weight formed therein.

14. A nail driving apparatus comprising:

a handle having a first and second end;

a rod member having a first end permanently secured to said second end of said handle and a second end forming a striking surface, said handle and said rod member secured together so as to form a longitudinal axis;

an elongated guide tube having a first end and a second end, said rod member being slidably disposed within said guide tube; and a magnet retaining means for storing a magnet, said magnet retaining means disposed about said second end of said guide tube, said magnet operative for holding a nail within said guide tube, said handle further comprising a circular slot located about said rod member, said circular slot defining a tapered circular surface within said handle, said circular slot operative for receiving said first end of said guide tube, said tapered circular surface operative for temporarily securing said guide tube within said handle.

15. A nail driving apparatus according to claim 14, wherein said magnet retaining means is formed from polyurethane.

16. A nail driving apparatus according to claim 14, wherein said rod member comprises an annular section having an increased diameter, and said guide tube comprises an annular section having a reduced diameter, said annular section of said rod member having a diameter larger than the diameter of said annular section of said guide tube, said annular section of said rod member and said annular section of said guide tube operative for preventing the rod member from being removed from said guide tube during operation.

17. A nail driving apparatus according to claim 16, wherein said annular section of said rod member is located substantially adjacent said second end thereof and said annular section of said guide tube is located substantially adjacent said first end thereof.

18. A nail driving apparatus according to claim 14, wherein said tapered circular surface has a reduced diameter at one end thereof such that upon forcefully inserting said guide tube into said circular slot, said guide tube engages said tapered circular surface of said handle, said engagement being sufficient to retain said guide tube within said handle.

19. A nail driving apparatus according to claim 18, wherein said guide tube is repeatedly removable from said engagement with said handle by application of a separation force.

20. A nail driving apparatus according to claim 14, further comprising a tube grip disposed about said guide tube, said tube grip being secured to said guide tube.

* * * * *